US005596675A

United States Patent [19]

Ishii et al.

[11] Patent Number: 5,596,675

[45] Date of Patent: Jan. 21, 1997

[54] METHOD AND APPARATUS FOR SPEECH ENCODING, SPEECH DECODING, AND SPEECH POST PROCESSING

[75] Inventors: Jun Ishii; Shinya Takahashi, both of Kanagawa, Japan

[73] Assignee: Mitsubishi Denki Kabushiki Kaisha, Tokyo, Japan

[21] Appl. No.: 527,575

[22] Filed: Sep. 13, 1995

Related U.S. Application Data

[62] Division of Ser. No. 243,181, May 16, 1994.

[30] Foreign Application Priority Data

May 21, 1993 [JP] Japan ..... 5-119959

[51] Int. Cl.[6] ..... G10L 3/02

[52] U.S. Cl. ..... 395/2.2; 395/2.25; 395/2.29; 395/2.72

[58] Field of Search ..... 395/2.2, 2.16, 395/2.17, 2.25–2.32, 2.35, 2.67, 2.71–2.73, 2.42, 2.43, 2.78; 387/36–40, 46.51

[56] References Cited

U.S. PATENT DOCUMENTS 4,885,790 12/1989 McAulay et al. ..... 394/36

5,327,518 7/1994 George et al. ..... 395/2.2

OTHER PUBLICATIONS

"Development of Low Bit–Rate Coding System for High Quality Audio Signal" by Watanabe, Audio Sound Research Department, pp. 37–39, Jun. 13, 1992.

*Primary Examiner*—Kee M. Tung
*Attorney, Agent, or Firm*—Wolf, Greenfield & Sacks, P.C.

[57] ABSTRACT

A speech analysis unit and a window locating means are implemented in a speech coding apparatus. The speech coding apparatus encodes input speech per analysis frame defined having a fixed length and is offset at fixed interval. The speech analysis unit extracts frequency spectrum characteristic parameters of the input speech taken within an analysis window. The location of the analysis window is specified by the window locating means. The window locating unit selects the location of the analysis window which is used in extracting the frequency spectrum characteristic parameters at the speech analysis unit. In this case, depending upon the characteristic parameter of the input speech within and near the frame concerned, the window locating unit selects the location of the analysis window within the range which is not to be exceeding the range of the frame concerned.

16 Claims, 15 Drawing Sheets

OCT = OCTAVE

M : HARMONICS NUMBER
Tmj : NOMINATED THRESHOLD
Am : HARMONIC AMPLITUDE VALUE
Tm : THRESHOLD

DECODED SPEECH x' n

FREQUENCY SPECTRUM X'k

FREQUENCY SPECTRUM CX'k

DISCRETE INVERSE
FOURIER TRANSFORM

OUTPUT SPEECH cx'k

METHOD AND APPARATUS FOR SPEECH ENCODING, SPEECH DECODING, AND SPEECH POST PROCESSING

This application is a division of application Ser. No. 08/243,181, filed May 16, 1994, entitled A METHOD AND APPARATUS FOR SPEECH ENCODING, SPEECH DECODING, AND SPEECH POST PROCESSING and now pending.

BACKGROUND OF THE INVENTION

1. Field of the Invention

The present invention relates to a method and apparatus for speech encoding, speech decoding, speech post processing, which are used when speech is transmitted digitally, stored and synthesized.

2. Description of the Related Art

In a conventional speech coding apparatus, input speech taken within analysis windows are analyzed by taking their frequency spectrum. The analysis windows are either aligned with the analysis frames or at a fixed offset from the analysis frames. The analysis frames are defined as having a fixed length and are offset at fixed interval. In a conventional speech decoding apparatus and a speech post processor, the quantization noise of synthesized speech is perceptually reduced by emphasizing peaks (formant) and suppressing other part of the speech spectrum. The peak is produced by the resonation of the vocal tract in the speech spectrum.

An article on the conventional speech coding/decoding apparatus is "Sine-Wave Amplitude Coding at Low Data Rates", (Advance in Speech Coding, Kluwer Academic Publishers, P203–213) of the article 1 by R. Macaulay, T. Parks, T. Quatieri, M Sabin. This article is hereinafter called "article 1". FIG. 12 shows a configuration of the speech coding/decoding apparatus stated in the article 1. The conventional speech coding/decoding apparatus comprises a speech coding apparatus 1, a speech decoding apparatus 2 and a transmission line 3. Input speech 4 is input into the speech coding apparatus 1. Output speech 5 is output from the speech decoding apparatus 2. A speech analysis means 6, a pitch coding means 7, a harmonics coding means 8 are implemented in the speech coding apparatus 1. A pitch decoding means 9, a harmonics decoding means 10, an amplitude emphasizing means 11 and a speech synthesis means 12 are implemented in the speech decoding apparatus 2. The speech coding apparatus 1 has lines 101, 102, 103. The speech decoding apparatus 2 has lines 104, 105, 106, 107.

FIG. 13 shows speech waveforms resulting from operation of the conventional speech coding and decoding apparatus.

The operation of the conventional speech coding/decoding apparatus is described with reference to FIGS. 12 and 13. The input speech 4 is input into the speech analysis means 6 through the line 101. The speech analysis means 6 analyzes the input speech 4 per analysis frame having a fixed length. The speech analysis means 6 analyzes the input speech 4 within an analysis window. The analysis window, that is, for instance, a Hamming window, has its center at the specific location in the analysis frame. The speech analysis means 6 extracts a power P of the input speech within the analysis window. The speech analysis means 6 also extracts a pitch frequency by using, for instance, an auto correlation analysis. The speech analysis means 6 also extracts an amplitude Am and a phase θm (m is a harmonic number) of a harmonic components on a frequency spectrum at an interval of the pitch frequency by a frequency spectrum analysis. FIG. 13 show an example of calculating the amplitude Am of the harmonic components on the frequency spectrum by picking up input speech within one frame. The pitch frequency (1/T, T stands for the pitch length) extracted by the speech analysis means 6 is output to a pitch coding means 7 through the line 103. The power P, and the amplitude Am and the phase θm of the harmonics are output to a harmonics coding means 8 through the line 102.

The pitch coding means 7 encodes the pitch frequency (1/T) input through the line 103 after quantizing. The quantizing is, for example, done using a scalar quantization. The pitch coding means 7 outputs a coded data to the speech decoding apparatus 2 through a transmission line 3.

The harmonics coding means 8 calculates a quantized power P' by quantizing the power P input through the line 102. The quantizing is done, for example, using the scalar quantization. The harmonics coding means 8 normalizes the amplitude Am of the harmonic component input through the line 102 by using the quantization power P' to get a normalized amplitude ANm. The harmonics coding means 8 quantizes the normalized amplitude ANm to get a quantized amplitude ANm'. The harmonics coding means 8 quantizes, for example using the scalar quantization, the phase θm input through the line 102 to get a quantized phase θm'. Then the harmonics coding means 8 encodes the quantized amplitude and the quantized phase θm' and outputs the coded data to the speech decoding apparatus 2 through the transmission line 3.

The operation of the speech decoding apparatus 2 explained. The pitch decoding means 9 decodes the pitch frequency of the coded data of the pitch frequency input through the transmission line 3. The pitch decoding means 9 outputs the decoded pitch frequency to a speech synthesis means 12 in the speech decoding apparatus 2 through the line 104.

A harmonics decoding means 10 decodes the power P', and the amplitude ANm' and the phase θm' of the harmonic components, within the coded data input through the transmission line 3 from the harmonics coding means 8. The harmonics decoding means 10 calculates a decoded amplitude Am' by multlplying the amplitude ANm' by P'. The harmonics decoding means 10 outputs these decoded amplitude Am' and phase θm' to an amplitude emphasizing means 11 through the line 105.

The decoded amplitude Am' contains the quantization noise generated by quantizing. Generally, the human ear has a characteristic of perceiving less quantization noise at peaks (formant part) of the frequency spectrum than at bottoms. By using this characteristic, the amplitude emphasizing means 11 reduces the quantization noise to the human ear. As shown in FIG. 14, the amplitude emphasizing means 11 emphasizes the peaks of the decoded amplitude Am' and suppresses other part of Am'. Thus, the amplitude emphasizing means 11 reduces the quantization noise to the human ear. The emphasized amplitude AEm' and the phase θm' are output to a speech synthesis means 12 through the line 106.

Depending upon the input pitch frequency, the emphasized amplitude AEm' of the harmonic components and the phase θm' , the speech syntheses means 12 synthesizes a decoded speech S(t) using the following formula (1). The decoded speech S(t) is output as an output speech 5 through the line 107.

[Formula 1]

$$S(t) = \sum_m AEm'(t)\cos(\theta m'(t)) \quad (1)$$

FIG. 13 show an example of how the speech is synthesized from the amplitudes of each harmonics.

An article on a conventional speech post processor (postfilter) is "Unexamined Japanese Pat. Publication 2-82710", which is hereinafter called "article 2". FIG 15 shows a configuration of the conventional speech decoding apparatus with the postfilter stated in article 2. A decoding means 15, a postfilter means 16 and lines 121, 122 are implemented in the speech decoding apparatus.

The operation of the conventional speech post processor is explained with reference to FIG. 15. By some way of decoding, the decoding means 15 decodes a coded data input through the transmission line 3 to get a decoded speech x'n. The decoded speech x'n is output to a postfilter means 16 through the line 121. The postfilter means 16 performs the filtering process with a characteristic H(Z) ( Z stands for Z transform) for the filtered speech x'n. The postfilter means 16 outputs the decoded speech as the output speech 5 after the filter process. The characteristic H(Z) also has a character of emphasizing the formant part and suppressing the other parts except the formant part. Thus, the postfilter means 16 reduces a quantization noise element of the speech spectrum except the formant part perceptually.

PROBLEMS TO BE SOLVED BY THE INVENTION

In the conventional speech coding apparatus shown in FIG. 12, the location of the analysis window defined in the speech analysis means 6 is fixed against the analysis frame. Therefore, when the input speech within the analysis window W changes largely from unvoiced to voiced as shown by the input speech waveform in FIG. 16, extracted frequency spectrum parameters sometimes have intermediate characteristics which are between voiced sound patterns and unvoiced sound patterns. Consequently, it has been a problem that the output speech synthesized in the speech decoding apparatus is not clear and then the sound quality becomes bad.

Also, in the conventional speech decoding apparatus shown in FIGS. 12 and 15, the formant part of the speech is emphasized and the other parts are suppressed so as to reduce the quantization noise perceptually. In such a formant emphasizing process, the frequency spectrum is transformed too much when amplification factor and suppression factor become high to reduce the quantization noise. Consequently, the quality of the output speech becomes insufficient.

The object of the present invention is to solve the above problems to get a good quality output speech.

SUMMARY OF THE INVENTION

A speech coding apparatus according to one aspect of the present invention comprises a speech analysis means which extracts frequency spectrum characteristic parameters and a window locating means which selects a location of an analysis window depending upon the characteristic parameter of input speech and sends a direction to the speech analysis means.

The speech analysis means calculates and outputs a value of power of the input speech as a power of analysis frame concerned. This input speech is analyzed within an analysis window whose center is at the center of the analysis frame concerned.

A speech decoding apparatus according to one aspect of the present invention has an amplitude suppression means which partially suppresses amplitudes of harmonics on a frequency spectrum at the interval of the pitch frequency.

A speech post processor according to one aspect of the present invention comprises a transform means, an amplitude suppression means and an inverse transform means. The transform means transforms a synthetic speech into a frequency spectrum. The amplitude suppression means suppresses each frequency component of the frequency spectrum output from the frequency transform means partially. The inverse transform means transforms the frequency spectrum output from the amplitude suppression means into time domain and outputs the transformed signal outside.

A method for speech encoding, speech decoding and post processing speech according to the present invention is used in the above apparatus.

A window locating means selects a location of the analysis window depending upon the characteristic parameters of the input speech within and near the frame. The location of the analysis window is used when the frequency spectrum characteristic parameter is extracted in the speech analysis means. The window locating means sends a direction on the selected location to the speech analysis means. In this case, the location of the analysis window is selected within the range and not exceeding the range of the analysis frame concerned. The speech analysis means calculates and outputs a value of power of the input speech, which is taken by locating the center of the analysis window at the center of the frame every time, as the power of the frame.

The amplitude suppression means of the present invention suppresses the amplitude of the harmonics on the frequency spectrum, at the interval of the pitch frequency, when a component of the harmonics is masked perceptually by effects of other neighboring harmonics.

The transform means of this invention transforms the synthetic speech into the frequency spectrum. When the frequency component is masked by the effect of the other neighboring frequency components, the amplitude suppression means suppresses the amplitude of the frequency component of the frequency spectrum which is output from the transform means. The inverse transform means transforms the frequency spectrum output from the amplitude suppression means into time domain and outputs it outside.

As mentioned above, according to the present invention, it is possible to remove the effect of the unvoiced characteristic on the frequency spectrum when there are voiced parts and the unvoiced parts in the frame. Consequently, there is an effect of getting a fairly clear and natural decoded speech quality. In addition, there is the effect of reducing the quality deterioration of the decoded speech produced by the quantization errors on the frequency spectrum since the frequency components which can be ignorable perceptually are masked.

DESCRIPTION OF THE PREFERRED EMBODIMENTS

Embodiment 1

Figure 1:
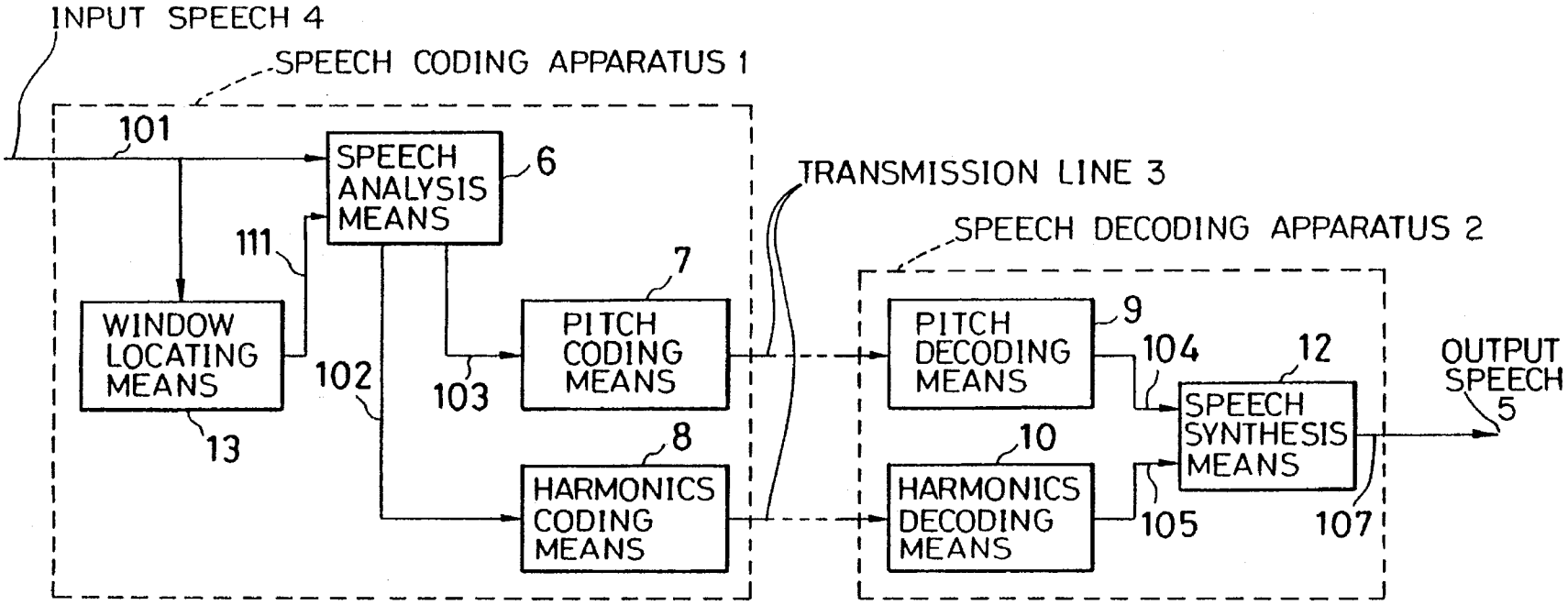
FIG. 1 shows a configuration of the embodiment 1 of the present invention.
Figure 2:
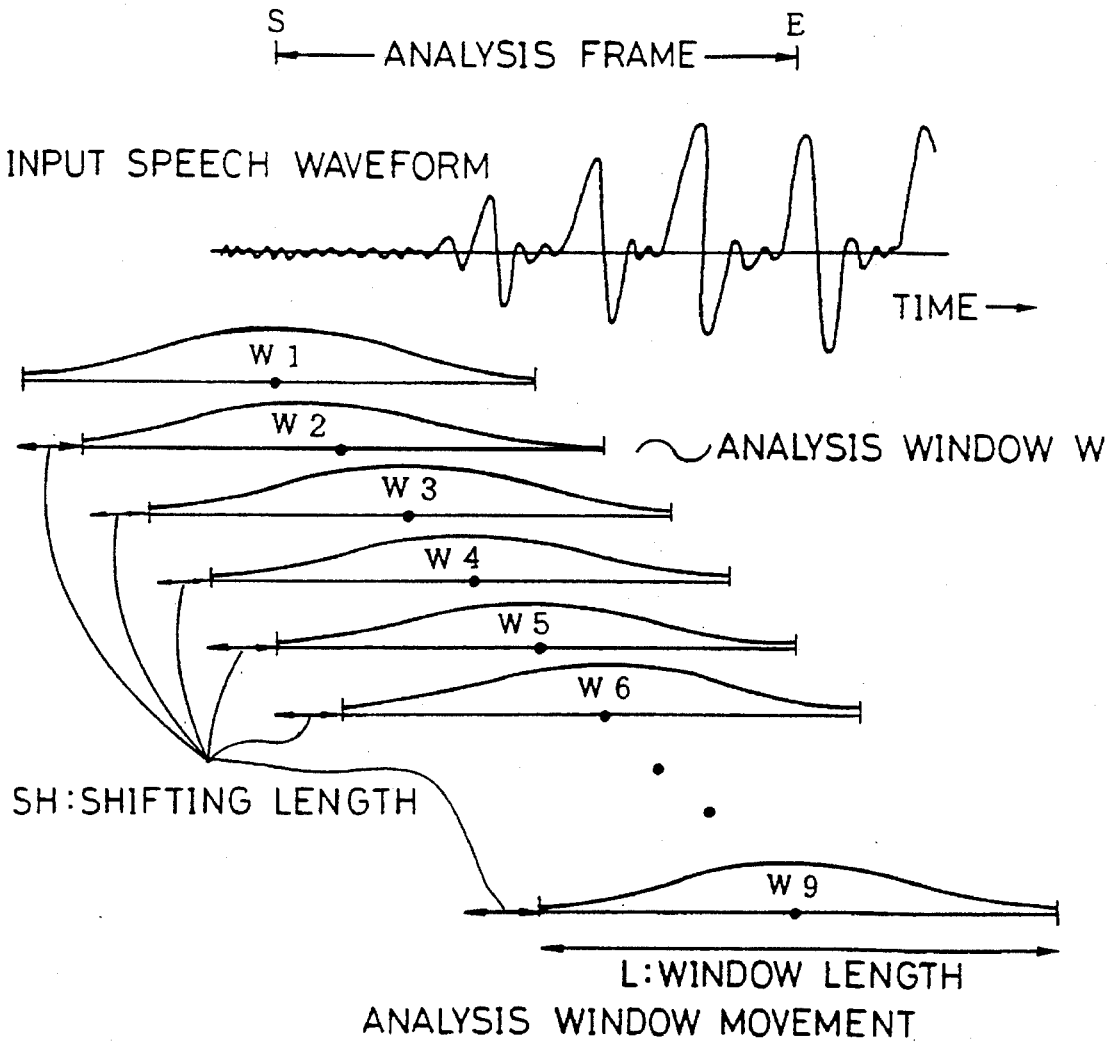
FIG. 2 explains the embodiment 1 of the present invention.

FIG. 1 shows an example of embodiments of the present invention. FIG. 1 is a configuration of a speech coding apparatus 1 which encodes input speech, and a speech decoding apparatus 2 which decodes the encoded speech. FIG. 2 shows an operation of this embodiment.

Figure 12:
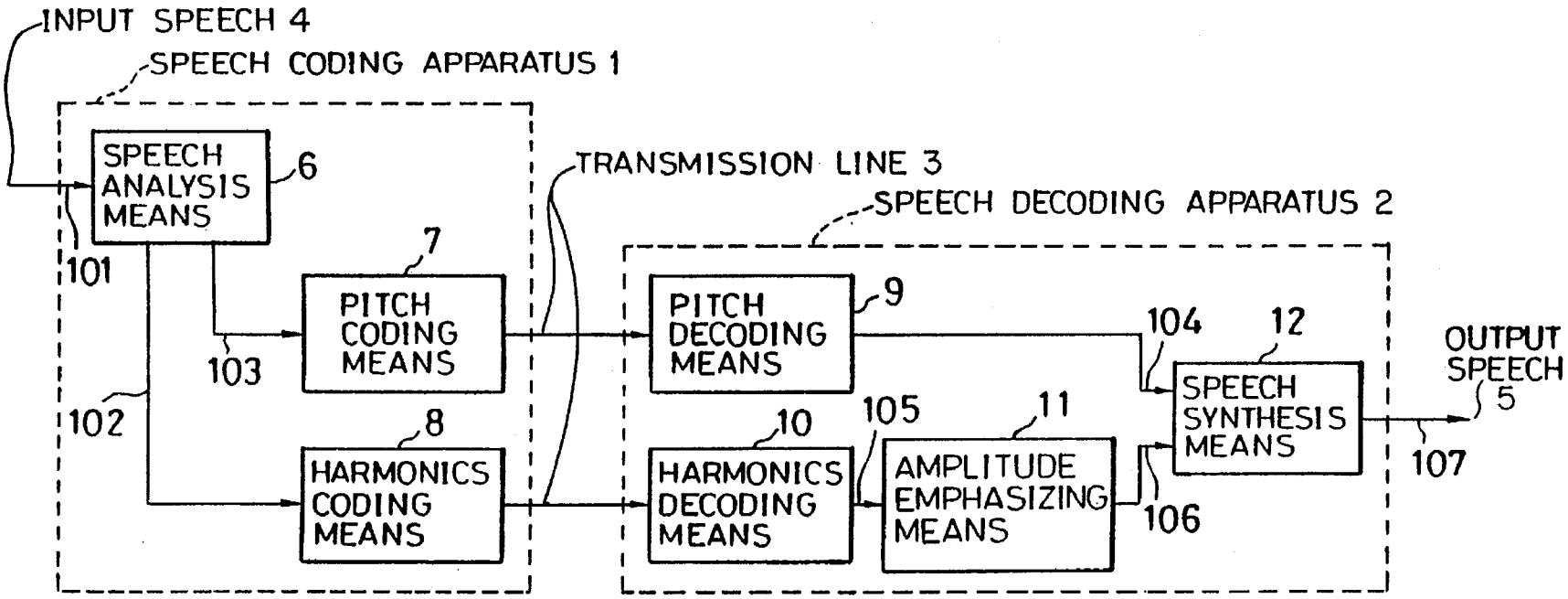
FIG.12 PRIOR ART
FIG. 12 is a configuration of the conventional speech coding apparatus and the speech decoding apparatus.
Figure 13:
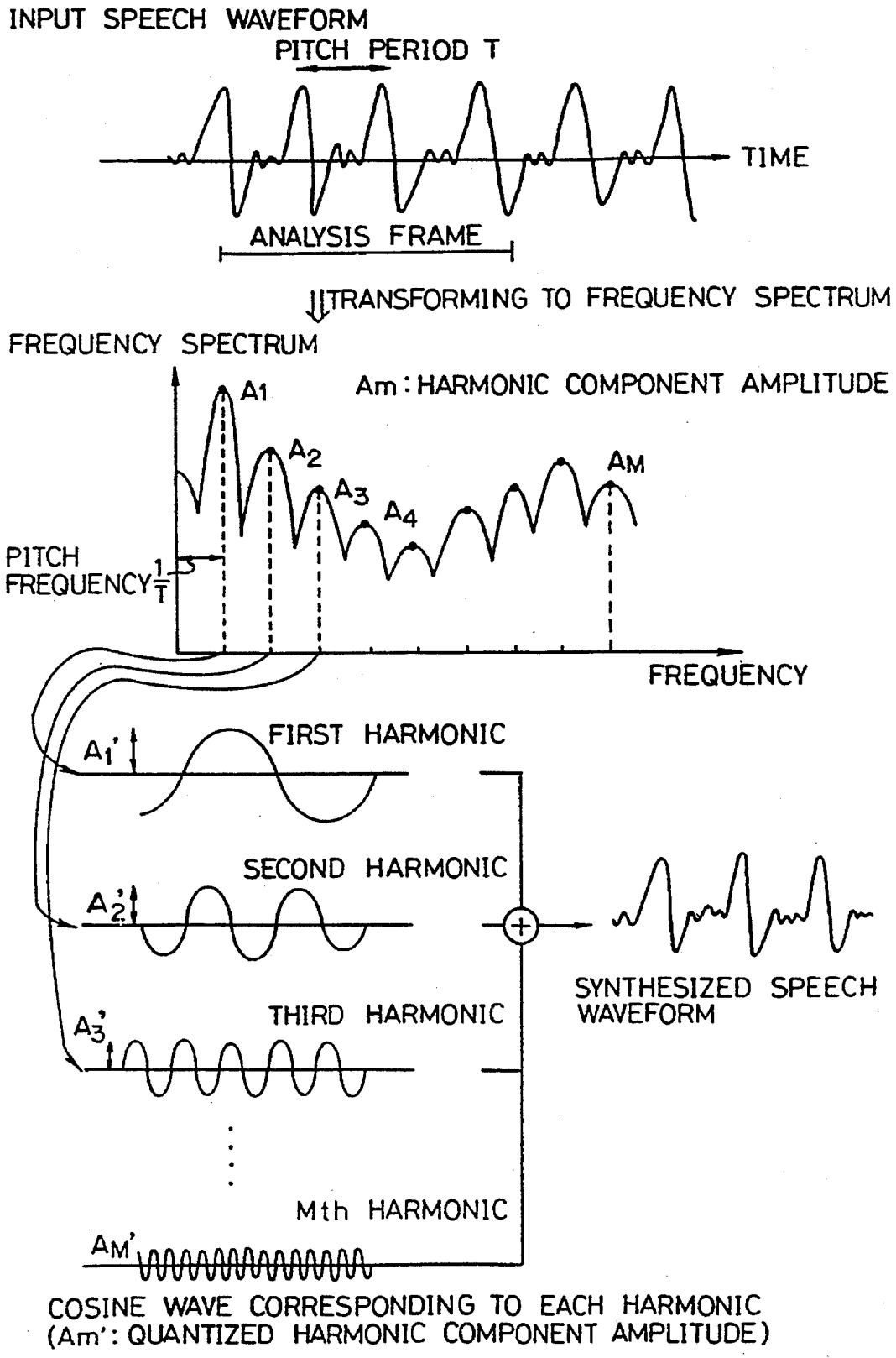
FIG.13 PRIOR ART
FIG. 13 explains the conventional speech coding apparatus and the speech decoding apparatus.
Figure 14A:
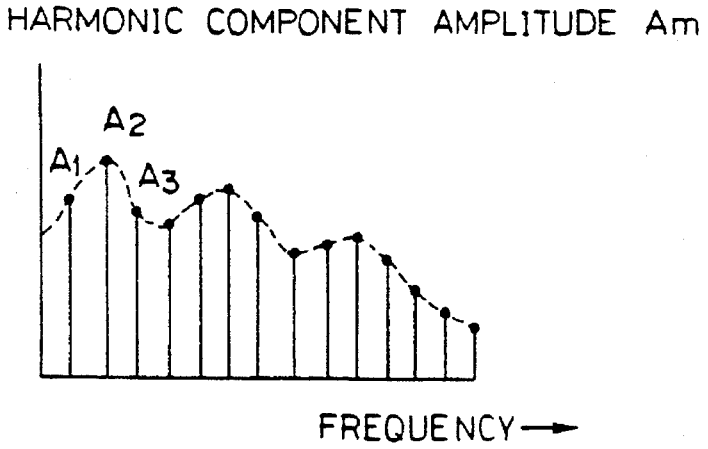
FIG. 14 explains the conventional speech decoding apparatus.
Figure 14B:
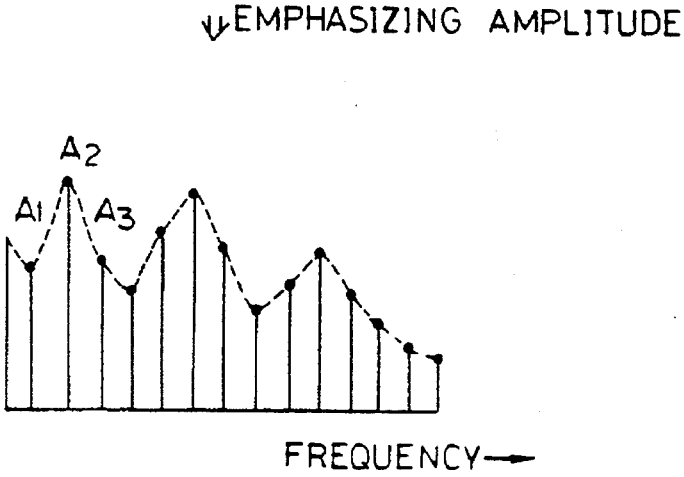

In FIG. 1, elements corresponding to the elements of FIG. 12 are named coincidently and explanations about them are omitted. A window locating means 13 and a line 111 are implemented in the speech coding apparatus 1 in FIG. 1.

Now, the operation of the embodiment shown in FIG. 1 is explained. As shown in the waveform of input speech in FIG. 2, in some cases, the input speech changes from unvoiced to voiced largely even in one analysis frame. In this case, a clear frequency spectrum parameter can be calculated if the frequency spectrum is taken based on the speech which is taken at the center of the voiced sound because the unvoiced sound has little effect on the speech. The window locating means 13 shifts an analysis window to find the location of the voiced part in the frame. As shown in FIG. 2, the input speech is taken one after another by shifting the analysis window per fixed time within the current analysis frame range. The range of shifting the analysis window should not exceed the range of the frame too much. For instance, the center of the analysis window is shifted within the analysis frame.

FIG. 2 shows the case of analysis windows W1 to W9 offset at fixed intervals and having a fixed length. The center of the analysis window W1 is at the edge S of the analysis frame. The center of the analysis window W9 is at the other edge E of the analysis frame. The window locating means 13 calculates values of power of input speech taken one after another within the analysis windows. The window locating means 13 selects a location of the analysis window which has the maximum value of power. The window locating means 13 outputs the location of the analysis window having the maximum value of power to a speech analysis means 6 through a line 111.

Figure 3:
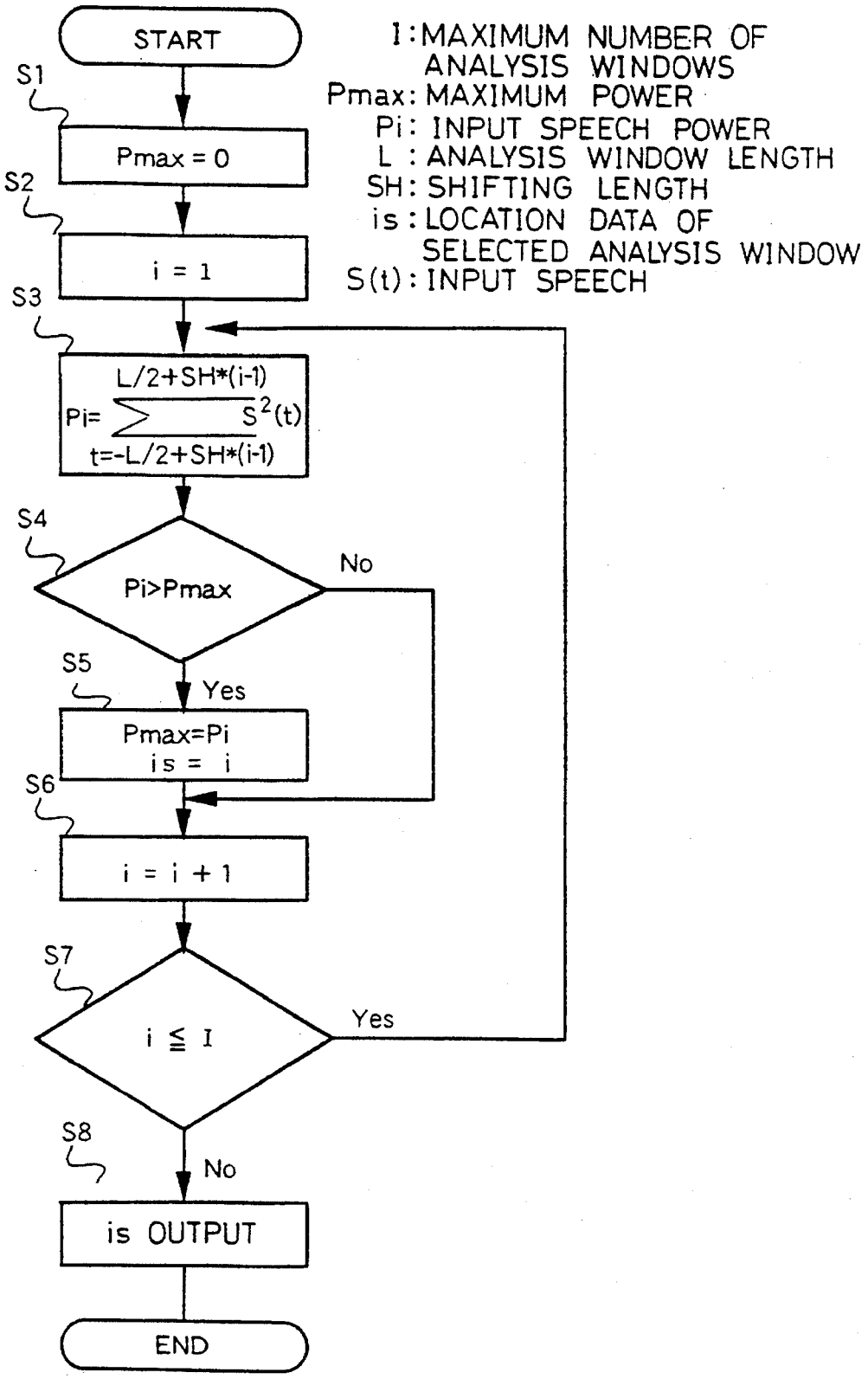
FIG. 3 is a flowchart of the embodiment 1 of the present invention.

FIG. 3 is a flowchart showing one example of a selecting process of the window location at the window locating means 13.

First, variables used in the flowchart of FIG. 3 are explained. "I" stands for the maximum number of the analysis windows to be allocated at the analysis frame. Since there are 9 analysis windows in the example shown in FIG. 2, "I" is defined to be nine (I=9). "Pi" stands for the power of the input speech calculated by using the ith analysis window (i=1, 2, 3 . . . I). "L" is a length of the analysis window. "SH" is a shifting length when the analysis window is shifted. "is" stands for data about the location of the selected analysis window. "Pmax" is the maximum power value among the power "Pi". "S(t)" is the input speech.

The flowchart of FIG. 3 is explained using these variables. At Step S1, the maximum power value Pmax is set at the initial value of 0. The maximum power value Pmax is the variable used for finding the maximum power. Therefore Pmax is updated whenever a new maximum power value is found. At Step S2, "i" is initialized to 1.

Steps S3 to S7 are a routine which loops I times (I is the maximum number of analysis windows). The power Pi of the input speech S(t) is calculated at Step S3. The power Pi is calculated as a sum of squared value of the input speech S(t) for the window length. At Step S4, the power Pi calculated at S3 is compared to the maximum power value Pmax, which has been already calculated, to find which of the two is higher. When the power Pi calculated at Step S3 is higher than the maximum power value Pmax calculated before, Pi is substituted for Pmax, and "i", indicating the place of the analysis window, is put in the data "is" which shows the location of the selected analysis window.

"i" is incremented by 1 (one) at Step S6. At Step S7 "i" is compared to "I" which is the maximum number of the windows. When "i" is smaller than "I", the process from Steps S3 to S7 is repeated. Thus, the process from Steps S3 to S7 is repeated as many times as the maximum number of windows, then the maximum power value Pmax and data "is" about the selected window location are calculated. At Step S8, the data "is" about the selected window location is output to a speech analysis means 6 through the line 111. The above constitutes the operation of the window locating means.

The speech analysis means 6 takes speech at a location based on the data "is" about the selected window location. The data "is" is input through the line 111. The speech analysis means 6 calculates a pitch frequency of the taken speech. The speech analysis means 6 calculates an amplitude Am and a phase θm of a harmonics on a frequency spectrum at the interval of the pitch frequency.

The speech analysis means 6 calculates a power P of the speech taken by locating the center of the analysis window at the center of the frame concerned. In the example of FIG. 2, the power P is calculated by using an analysis window W5. Thus, the power of the input speech is taken by locating the center of the analysis window at the center of the frame every time. The power of the input speech taken is used as the power of the frame. The calculated amplitude Am and the phase θm of the harmonics and the power P are output to a harmonics coding means 8 through a line 102.

Thus, the amplitude and the phase of the harmonics are calculated by using the analysis window having the maximum power value, which prevents an output speech from being unclear. Since the value of power of the frame is calculated from the center of the frame, the output speech has a power consistency.

As mentioned above, it is a feature of this embodiment to implement the speech analysis means and the window locating means in the speech coding apparatus. The speech coding apparatus encodes the input speech per analysis frame having a fixed length and is offset at fixed interval. The speech analysis means takes the input speech by using the analysis window whose location is designated by the window locating means. Besides, the speech analysis means extracts the frequency spectrum characteristic parameter of the taken input speech. The window locating means selects a location of the analysis window, which is used in extracting the frequency spectrum characteristic parameter at the speech analysis means, depending upon the characteristic parameter of the input speech within and near the frame concerned. When the location of the analysis window is selected, it is not to be exceeding the range of the frame concerned. The window locating means sends a direction about the selected window location to the speech analysis means.

It is also a feature of this embodiment to implement the speech analysis means which calculates and outputs the value of power of the input speech taken by locating the center of the analysis window at the center of the frame every time, as the power of the frame.

By using the method of this embodiment, when there are voiced parts and unvoiced parts in a frame, it is possible to remove an effect of an unvoiced part on a frequency spectrum since the frequency spectrum is calculated by centering the analysis window mainly on the voiced part. The voiced part which has a large speech power is more important than the unvoiced part perceptually. Besides, it is possible to get a consistency between the power of output speech and the power of input speech since the speech power value is calculated using the analysis window at the center of the frame. Consequently, the above method has an effect of getting a fairly clear and natural decoded speech quality.

Although the case of allocating nine analysis windows against one frame is explained in FIG. 2, the number of the analysis windows is not necessary to be nine always. Any plural number is acceptable. The case of the center of the analysis window W1 being at the edge S of the analysis frame and the center of the analysis window W9 being at the other edge E of the analysis frame has been stated. This is just an example of showing the range of the analysis window not exceeding the range of the frame. It is not necessary for the center of the analysis window to be at the edge of the analysis frame. In the case of shifting the analysis windows, it is important to shift the analysis windows within the range wherein the characteristic of the input speech in the frame can be specified.

Although the case of the window length L being the same as the analysis frame length has been shown in the example of FIG. 2, it is not necessary for the window length L to be the same length as the analysis frame length. It is acceptable for the length of the analysis frame to be different from the length of the analysis window.

Although the case of the analysis windows being shifted from W1 to W9 in turn at a fixed offset has been explained in the example of FIG. 2, it is not necessary to be shifted at the fixed offset. Being shifted at random or shifted at other prescribed rule is acceptable.

Although the analysis windows are shifted from W1 to W9 in turn in time, it is not necessary to be shifted in time as long as the window locating means 13 has a memory which can memorize the input speech in the analysis frame. In the case of the input speech being memorized in the memory, the analysis windows from W1 to W9 can be shifted in inverse order or random order.

The case of the analysis window having the maximum input speech power value being selected from the analysis windows has been explained in the example of FIG. 3. Not only the value of power of the input speech but also other characteristic parameter can be used in selecting the analysis window. The reason for the analysis window having the maximum power value being used after comparing the power of each analysis window is that the voiced part has a higher power value than the unvoiced part generally when there are both voiced and unvoiced parts in one frame. Accordingly, any characteristic parameter can be used as long as the characteristic parameter can distinguish the voiced part from the unvoiced part.

For example, a spectrum pattern can be used as the characteristic parameter of the input speech instead of the value of power. There is a characteristic relation between the frequency and the amplitude in the spectrum pattern in the voiced part. Namely, the lower the frequency is, the larger the amplitude is. That is, the higher the frequency is, the smaller the amplitude is. However, in the unvoiced part, the spectrum pattern tends to be flat or the amplitude becomes large as the frequency becomes high generally. Accordingly, it is possible to distinguish the voiced part from the unvoiced part by checking the spectrum pattern in shifting the analysis windows.

As another instance of the characteristic parameter, an auto correlation analysis can be used. Since the waveform of the input speech has a periodic pattern in the voiced part, an auto correlation function indicates a periodic characteristic. However, in the unvoiced part, the auto correlation function indicates a random value having no periodic characteristic. Accordingly, it is possible to distinguish the voiced part from the unvoiced part by calculating the auto correlation function of the input speech taken by each analysis window in shifting the analysis windows.

In the above example, the case of the power value of the input speech being calculated by locating the center of the analysis window at the center of the analysis frame has been explained. It is not necessary to use the analysis window whose center is at the center of the analysis frame. The reason for using the analysis window whose center is at the center of the analysis frame is that it is thought the value of power of the analysis frame can be extracted best by using such window. So another analysis window being at another place can be used as long as the analysis window can extract the value of power of the analysis frame appropriately.

The analysis window selected by the window locating means has a defect of having too high power comparing to other analysis frames since the analysis window indicates the voiced part having a high speech power. Thus, the power consistency of the speech can be made better by using another analysis window instead of the analysis window selected by the window locating means. Any analysis window is acceptable as long as the analysis window can get the power consistency.

Although the case of the length L of the analysis window which is shifted by the window locating means being as long as the length L of the analysis window used for calculating the value of power of the analysis frame has been explained in this example, it is acceptable that there be a difference between the both lengths. It is desirable that the length of the analysis window for calculating the value of power of the analysis frame is as long as the length of the analysis frame, since the analysis window is used for calculating the value of power of the frame. However, the length of the analysis window for taking the input speech can be longer or shorter than the length of the analysis frame.

Embodiment 2

Figure 4:
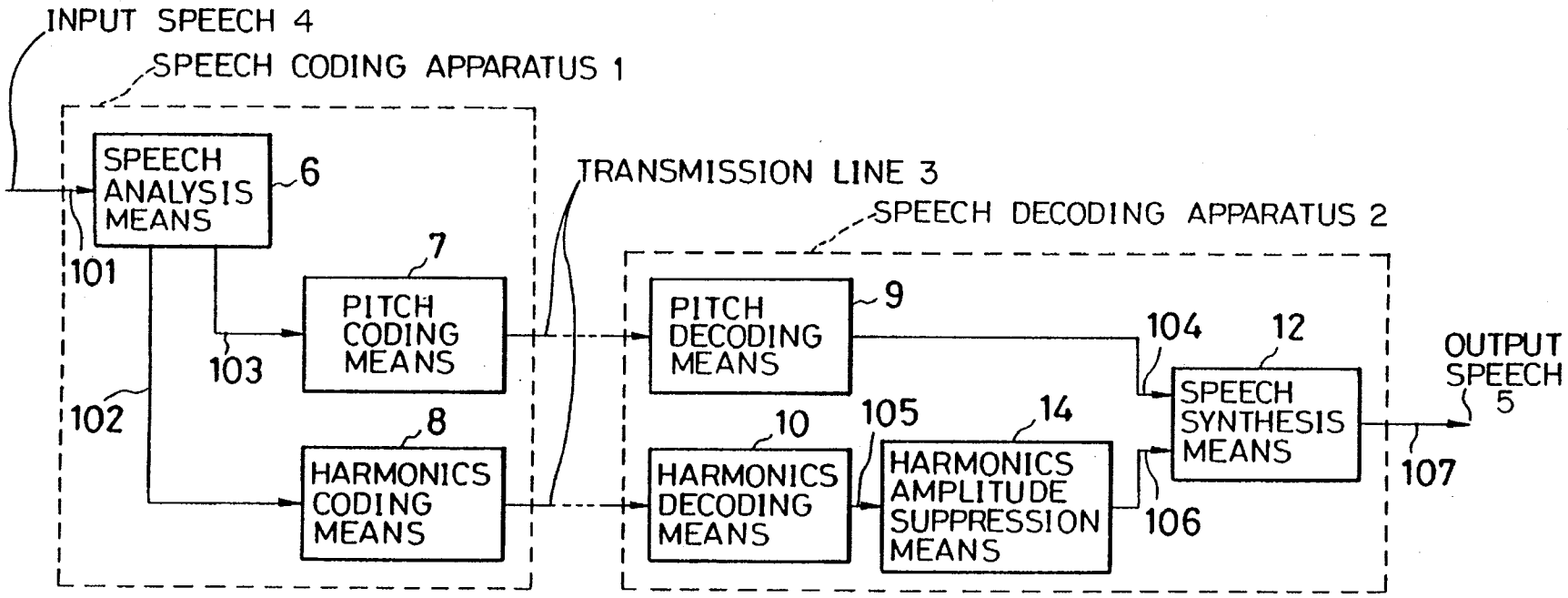
FIG. 4 shows a configuration of the embodiment 2 of the print invention.

FIG. 4 shows another example of the present invention. FIG. 4 is a configuration of a speech decoding apparatus which synthesizes a decoded speech. Elements in FIG. 4 corresponding to elements in FIG. 12 are named coincidently and an explanation about them is omitted here.

A harmonics amplitude suppression means 14 in FIG. 4 is implemented in the speech decoding apparatus 2. FIGS. 5, 6, 7, 8 illustrate an operation of the harmonics amplitude suppression means 14.

Figure 5:
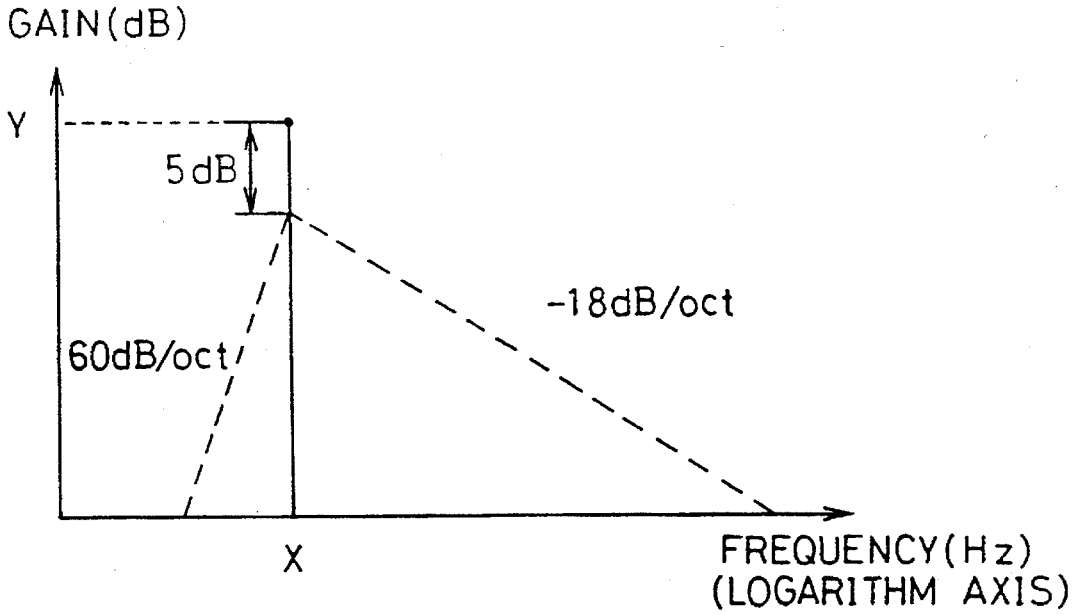
FIG.5 PRIOR ART
FIG. 5 explains a harmonics amplitude suppression means of the embodiment 2 of the present invention.

The operation of one of the embodiments relating to the present invention is explained with FIGS. 4 to 8. It is known that frequency components which are near the frequency component whose amplitude is large enough are masked and then it is difficult to perceive the frequency components in human ear. According to "Development of Low Bit-Rate Coding System" (from p. 37 to 42 of NHK document published by NHK Broadcast Technology Research Institute in May, 1992), which is hereinafter called "article 3", the following can be said as shown in FIG. 5. When the amplitudes in the frequency components near a frequency X which has an amplitude Y are below the threshold shown with the dotted line in FIG. 5, the frequency components are masked and then it is difficult to perceive them.

The method of calculating the threshold for the masking stated in the article 3 is used at the speech coding apparatus. Namely, in coding of speech, data amount is reduced to increase a transmission efficiency. The data amount is reduced by not coding the harmonic which can be masked because of the characteristics of the human ear. It is an advantage of this embodiment to use the method stated in the article 3 for the speech decoding apparatus, not for the speech coding apparatus, for the purpose of removing a quantization noise generated in quantizing the amplitude at the speech coding apparatus.

The explanation about this embodiment is as follows.

The quantization noise is generated when the amplitude Am of the harmonic components is quantized at the speech coding apparatus. In a conventional speech decoding apparatus, a formant part is emphasized and other part is suppressed to reduce the quantization noise of the speech spectrum except the formant part perceptually. Accordingly, it has been a problem that the whole frequency spectrum has been deformed, then the speech quality becomes insufficient. However, if the amplitude of the harmonic which can be masked out because of the characteristics of the human ear is set at zero, the quantization noise of the harmonic concerned can be removed without generating a perceptual deterioration over the whole frequency spectrum.

The harmonics amplitude suppression means 14 inputs each harmonic component through a line 105. The harmonics amplitude suppression means 14 sets to zero the amplitude Am of the harmonic components, which is slightly perceived or masked out because of the characteristics of the human ear, out of the inputted harmonics. The harmonics amplitude suppression means 14 outputs the harmonic amplitude partially suppressed, to a speech synthesis means 12 through a line 106. The operation of the harmonics amplitude suppression means is explained with reference to FIGS. 6, 7 and 8 as follows.

Figure 6:
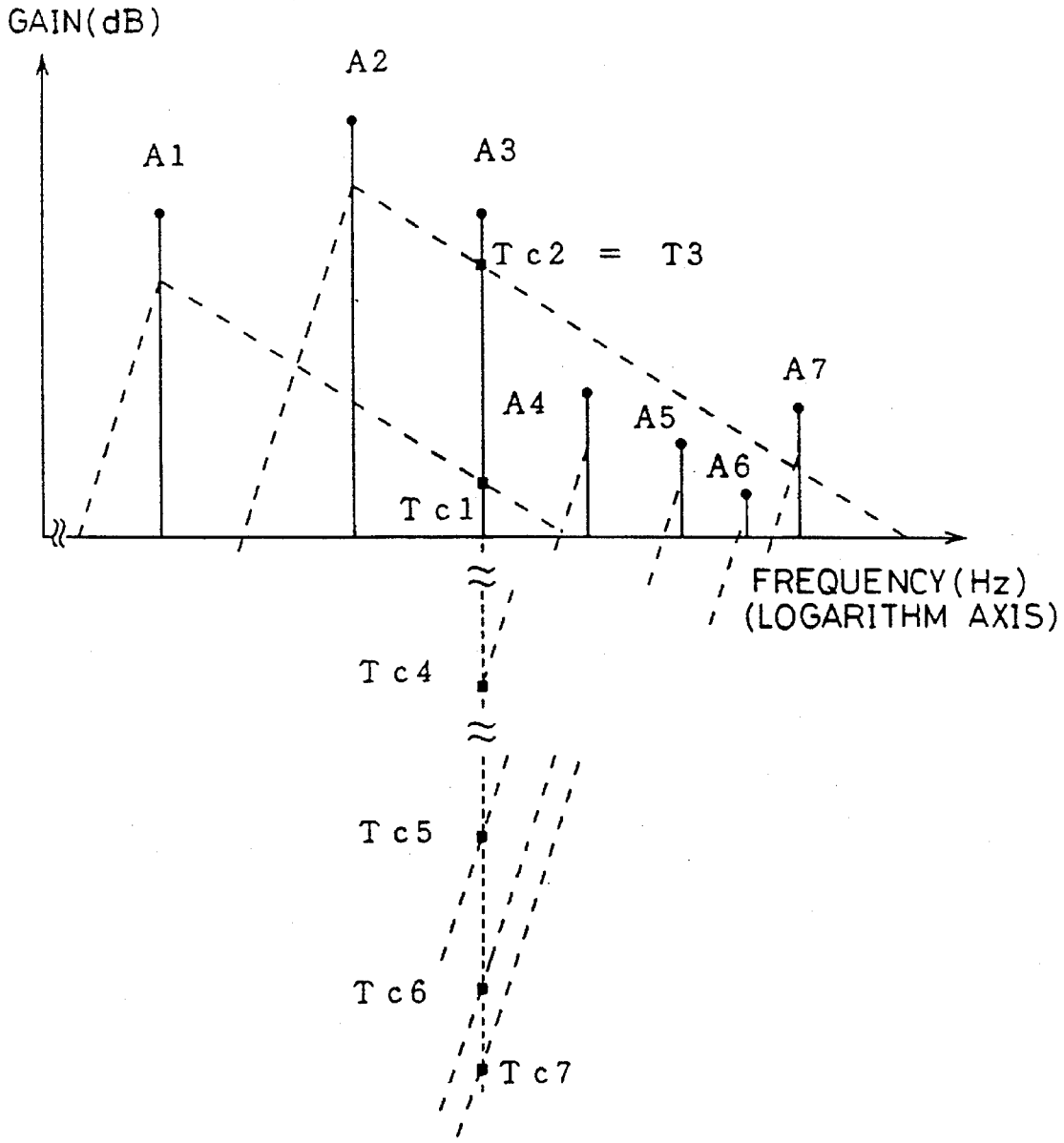
FIG. 6 explains the harmonics amplitude suppression means of the embodiment 2 of the present invention.
Figure 7:
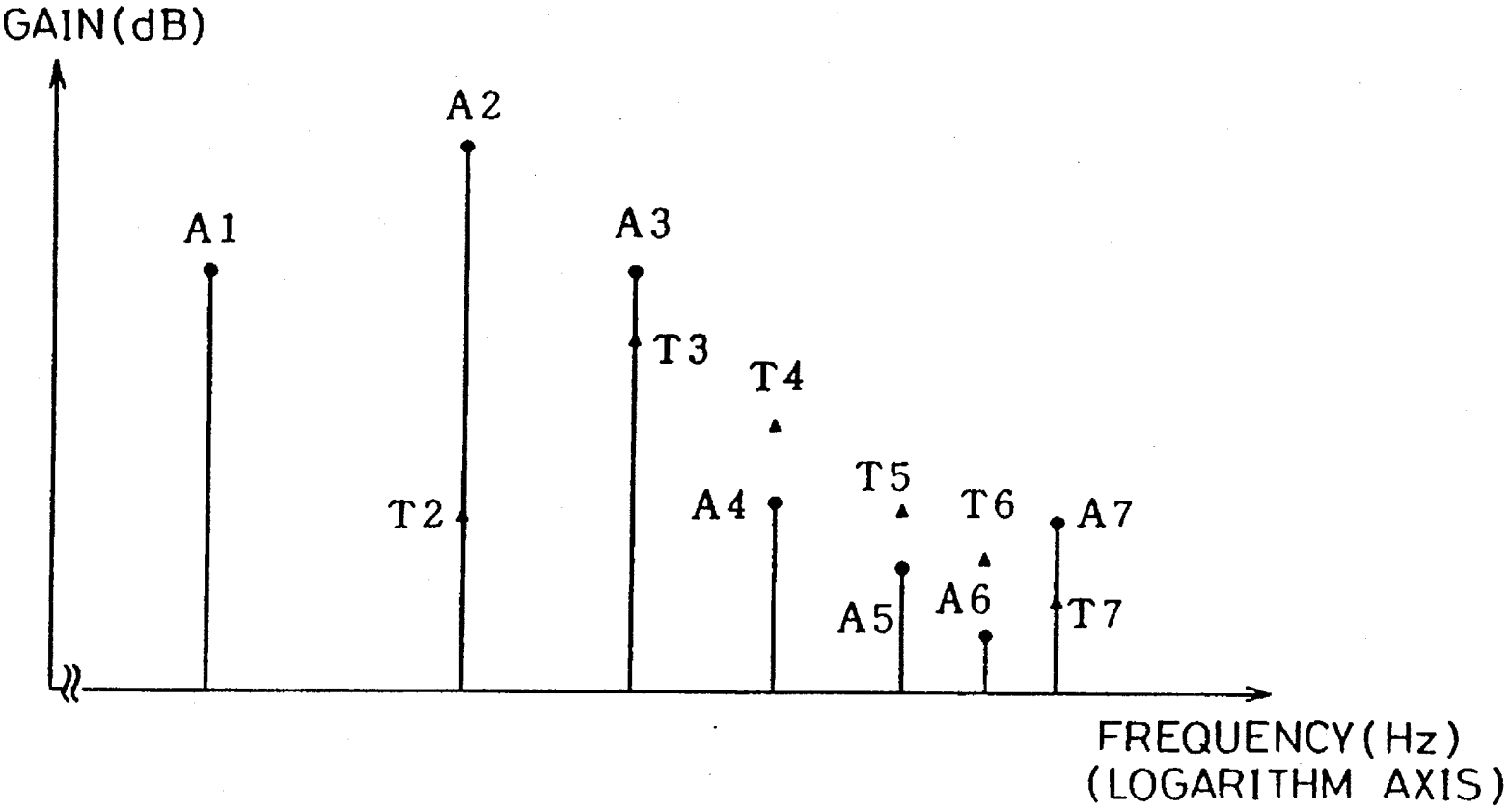
FIG. 7 explains the harmonics amplitude suppression means of the embodiment 2 of the present invention.

FIG. 6 shows an example of defining the threshold on the third harmonic. The case of there being the first to the seventh harmonics is explained here. Depending upon each amplitude Am (m=1 to 2, 4 to 7) of the harmonics except the third harmonic, the harmonics amplitude suppression means 14 defines nominated thresholds calculated from the amplitude Am around the third harmonic, using the characteristic shown in the dotted line of FIG. 5. The harmonics amplitude suppression means 14 defines the nominated thresholds to get the threshold which is used for deciding masking the third harmonic component or not. A nominated threshold for the harmonic amplitude calculated from the first harmonic for the third harmonic is named Tc1 here. Another nominated threshold for the harmonic amplitude calculated from the second harmonic for the third harmonic is named Tc2. Similarly, nominated thresholds calculated from the fourth to seventh harmonics for the third harmonic are named Tc4 to Tc7. The largest one among these Tc1 to Tc7 is defined as the threshold T3 for the third harmonic. In FIG. 6, since the nominated threshold Tc2 is the largest among Tc1 to Tc7, Tc2 is defined as the threshold T3 for the third harmonic.

Figure 8:
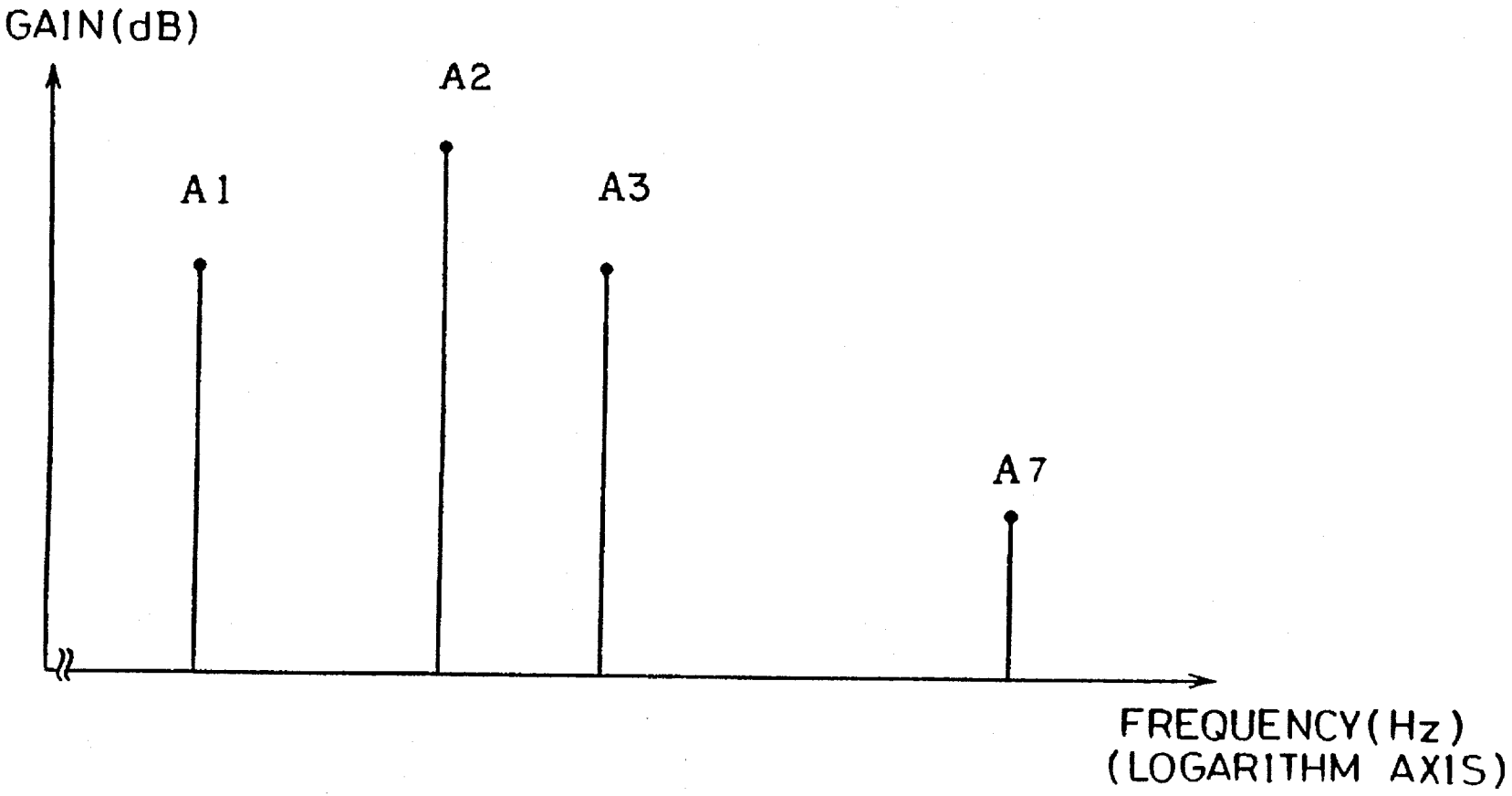
FIG. 8 explains the harmonics amplitude suppression means of the embodiment 2 of the present invention.

Similar processes are done for the other harmonics. The thresholds T1 to T7 for each harmonic amplitude are defined. The black triangle marks in FIG. 7 indicate the thresholds T1 to T7 for each harmonic amplitude. The fourth, the fifth, the sixth harmonics whose amplitude are below the threshold are decided to be masked. By setting amplitudes of the fourth, the fifth, the sixth harmonics to zero, the harmonic components shown in FIG. 8 are obtained.

Figure 9:
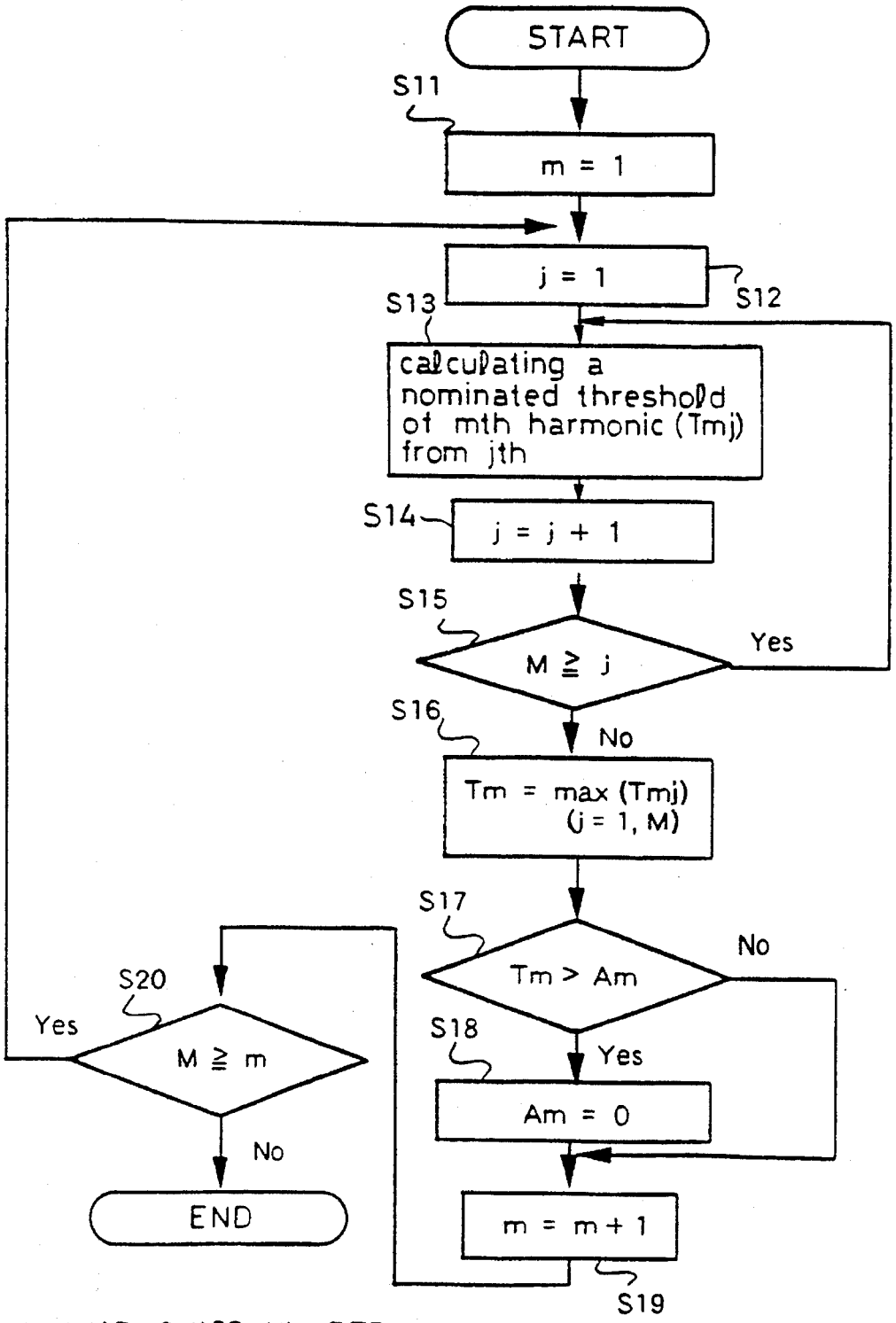
FIG. 9 is a flowchart of the embodiment 2 of the present invention.

FIG. 9 is a flowchart showing the operation of the harmonics amplitude suppression means 14. First, variables used in the flowchart are explained.

"M" is a harmonics number. "Tmj" stands for the nominated threshold calculated from the jth harmonic for the threshold of the mth harmonic. "Tm" is the maximum value of the Tmj which is the nominated threshold, in other words, Tm is the threshold of the mth harmonic. "Am" is a value of the harmonic amplitude.

Now, the operation of the flowchart is explained. At Step S11, 'm' is set to 1. The m is counted up to the harmonic number M. At Step S12, 'j' is set to 1. The j is counted up to the harmonic number M. The nominated threshold Tmj for the threshold of the mth harmonic is calculated from the jth harmonic at Step S13. j is incremented by 1 (one) at Step S14. j is checked if j has been counted up to harmonic number M at Step S15. Steps S12 to S15 is repeated M times using j as a loop counter. Thus, nominated thresholds for the threshold of the mth harmonic are all calculated.

The maximum value of the nominated threshold Tmj is selected at Step S16. The selected value are defined as the threshold Tm. The threshold Tm selected at Step S16 is compared to the value of the harmonic amplitude Am at Step S17. When the threshold Tm is larger than the value of the harmonic amplitude Am, the value Am is set to zero at Step S18. Thus, the value of the harmonic amplitude Am is masked in the case of the threshold Tm being larger than the Am.

m is incremented by 1 (one) at Step S19. m is compared to the harmonic number M at Step S20. m is used as the loop counter of Steps S12 to S20. Steps S12 to S20 are repeated M times which is the harmonic number. Thus, each harmonic is checked for masking. Harmonics which have not been masked are output from the harmonics amplitude suppression means 14 to the speech synthetic means 12 through the line 106.

The speech decoding apparatus of this embodiment operates as follows.

First, the speech decoding apparatus decodes the pitch frequency of the coded speech. Next, the speech decoding apparatus decodes the amplitude and the phase of the harmonic on the frequency spectrum at the interval of the pitch frequency. The speech decoding apparatus generates a cosine wave which has the frequency of each harmonic based on the amplitude and the phase of the decoded harmonic. The speech decoding apparatus synthesizes output speech by putting the cosine waves together.

It is a feature of the speech decoding apparatus of this embodiment to implement the harmonics amplitude suppression means. The harmonics amplitude suppression means suppresses the amplitude of the harmonic concerned when the harmonic component slightly perceived or masked perceptually by the effect of the harmonics around the harmonic concerned. The speech decoding apparatus also implements the speech synthetic means. Based on the amplitude and the phase of each harmonic output from the harmonics amplitude suppression means, the speech synthetic means generates the cosine wave which has the frequency of each harmonic. The speech synthetic means synthesizes the output speech by putting these cosine waves together.

By using the method of this embodiment, since the frequency component which is slightly perceived is masked, there is an effect of reducing speech quality deterioration of the decoded speech which is generated from a quantization error of the frequency spectrum.

A simple comparison test (preference check) between the speech made by masking in the speech decoding apparatus according to this embodiment and the speech made by amplifying the formant part in the conventional apparatus was held. The comparison test was attended by ten listeners to compare a subjective impression on a quality of the speech. The result of the test was that the masked speech of the present invention was selected as the preferred speech at the rate of 75 percent.

In this embodiment, the case of the harmonics amplitude suppression means 14 setting the amplitude of the harmonic, which is slightly perceived or masked, to zero is stated. It is not necessary to set to zero. The case of merely suppressing the value is acceptable. For instance, the case of halving the value or approximating the value to zero is also acceptable. In this embodiment, the case of the lower part than the dotted line being masked as shown in FIG. 5 is stated. The characteristic of FIG. 5 shows a range which is difficult for the human ear to perceive. However, not only the characteristic of FIG. 5 but also another characteristic is acceptable as long as the characteristic can specify the range which is difficult for human ear to perceive.

Embodiment 3

Figure 10:
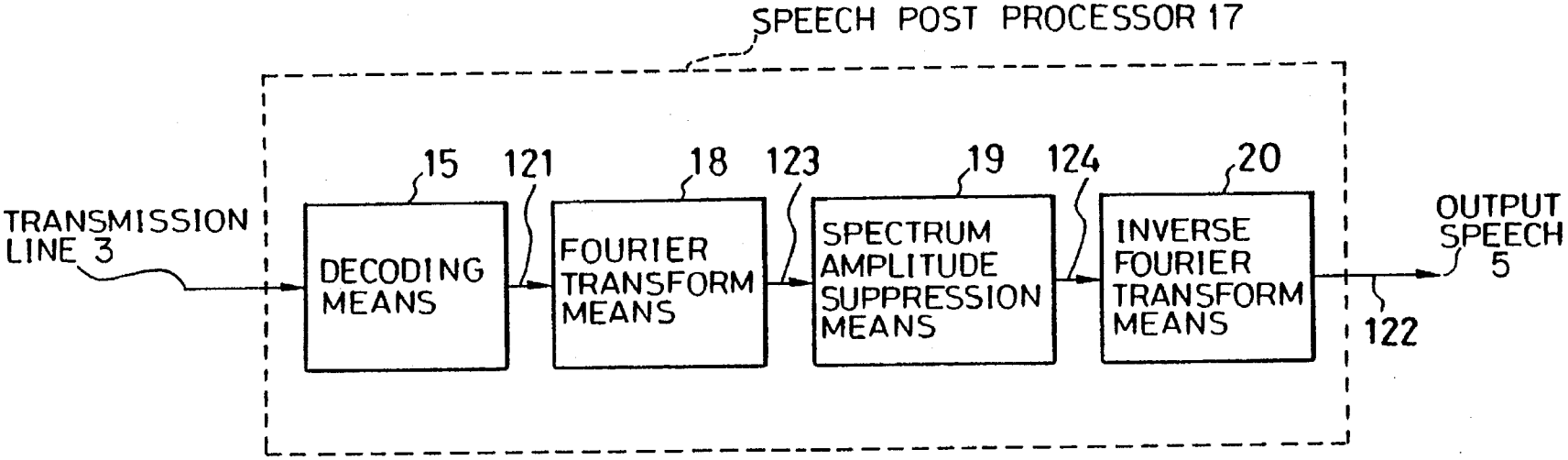
FIG. 10 shows a configuration of the embodiment 3 of the present invention.
Figure 11A:
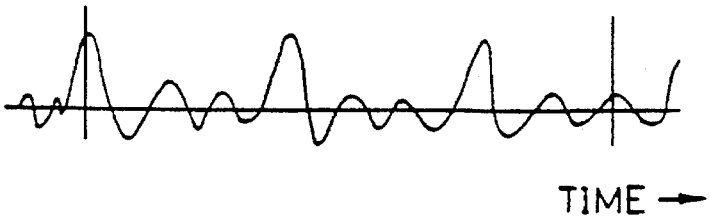
FIG. 11 explains the embodiment 3 of the present invention.
Figure 11B:
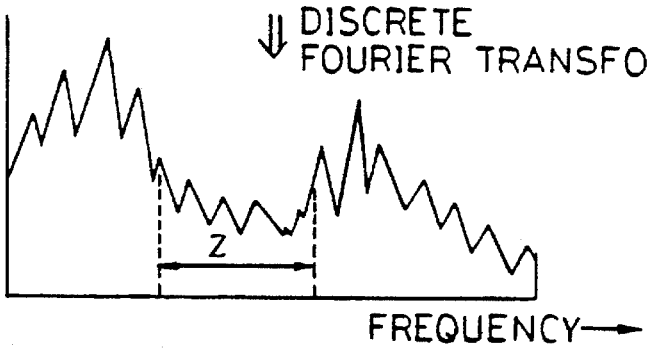
Figure 11C:
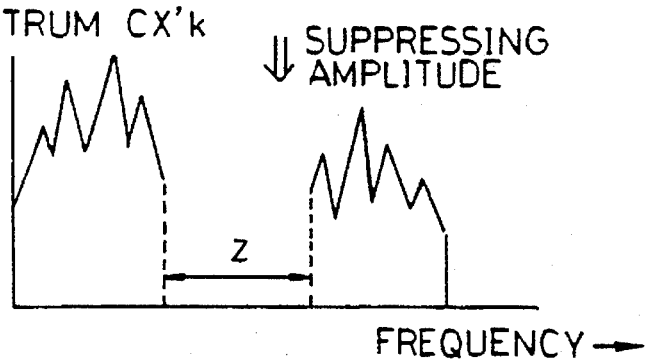
Figure 11D:
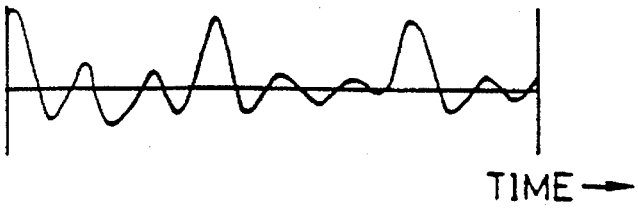
Figure 15:
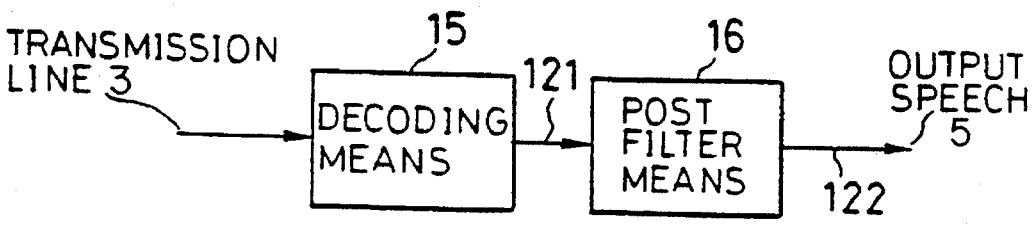
FIG.15 PRIOR ART
FIG. 15 is a configuration of the conventional speech decoding apparatus.
Figure 16:
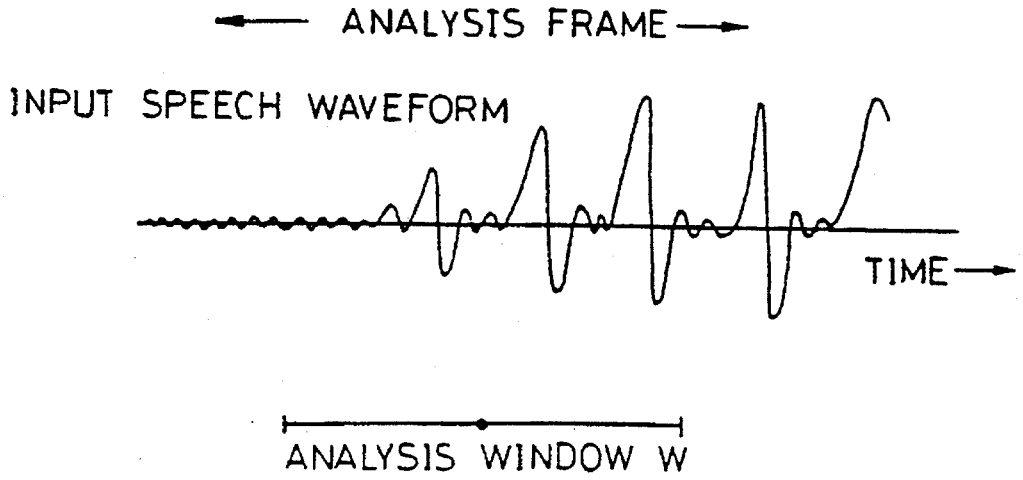
FIG.16 PRIOR ART
FIG. 16 shows a problem of the conventional speech coding apparatus.

FIG. 10 shows a configuration of the speech decoding apparatus comprising an embodiment of a speech post processor of the present invention. Elements of FIG. 10 corresponding to the elements of the conventional speech decoding apparatus of FIG. 15 are similarly numbered and the explanation of them are omitted.

In FIG. 10, a speech post processor 17, including a Fourier transform means 18, a spectrum amplitude suppression means 19, an inverse Fourier transform means 20, and lines 123–124 are implemented in the speech decoding apparatus.

In the above embodiment, the harmonics amplitude suppression means 14 is placed before the speech synthetic means 12 as explained. In this embodiment 3, the amplitude of the decoded speech is suppressed after the decoding by the decoding means 15.

The Fourier transform means 18 calculates a discrete frequency spectrum X'k by performing a discrete Fourier transform on the decoded speech x'n output from the decoding means 15. The Fourier transform means 18 outputs the discrete frequency spectrum X'k to the spectrum amplitude suppression means 19 through the line 123. The spectrum amplitude suppression means 19 suppresses the amplitude of the inputted discrete frequency spectrum X'k down to zero partially by using the same method as the harmonics amplitude suppression means 14 of FIG. 4. The harmonics amplitude suppression means 14 suppresses the amplitude of each harmonic down to zero partially depending upon the perceptual masking characteristic.

The operation of suppressing the frequency spectrum partially by the spectrum amplitude suppression means 19 can be also explained with reference to FIGS. 5 to 8 and the flowchart 9. In this case, it is necessary to replace the word "amplitude Am of the harmonic" for the word "amplitude of the frequency spectrum X'k" in reading the FIGS. A frequency spectrum CX'k whose amplitude is partially suppressed is output to the inverse Fourier transform means 20 through the line 124. The inverse Fourier transform means 20 calculates a signal cx'n on the time domain by performing discrete inverse Fourier transform based on the frequency spectrum CX'k and outputs the signal to the outside as the output speech 5 through the line 122.

FIG. 11 shows signals produced by a series of processes of the Fourier transform means 18, the spectrum amplitude suppression means 19 and the inverse Fourier transform means 20.

FIG. 11(*a*) shows the decoded speech output from the decoding means 15. FIG. 11(*b*) shows the frequency spectrum which is transformed from the decoded speech shown in FIG. 11(*a*) through the discrete Fourier transform by the Fourier transform means 18. FIG. 11(*c*) shows the frequency spectrum of FIG. 11(*b*) partially suppressed by the spectrum amplitude suppression means 19. In this case, the spectrum amplitude suppression means 19 suppresses the part which is slightly perceived or masked perceptually by using the same method as that of the harmonics amplitude suppression means 14 used in Embodiment 2. "Z" in FIG. 11(*c*) is a part whose amplitude was suppressed to 0(zero) by the spectrum amplitude suppression means 19. FIG. 11(*d*) shows the output speech which is transformed from the frequency spectrum shown in FIG. 11(*c*) through the discrete inverse Fourier transform by the inverse Fourier transform means. Thus, the decoded speech shown in FIG. 11(*a*) is output from the speech post processor 17 as the output speech shown in FIG. 11(*d*).

The spectrum amplitude suppression means 19 in the speech post processor 17 shown in FIG. 10 suppresses the spectrum amplitude of the discrete frequency spectrum. Since the spectrum amplitude suppression means suppresses the discrete frequency spectrum, the Fourier transform means 18 and the inverse Fourier transform means 20 are implemented to have a pre or post process.

The reason for suppressing the amplitude of the part which is slightly perceived or masked perceptually in the decoded speech already decoded by the decoding means 15, by using the Fourier transform means 18, the spectrum amplitude suppression means 19 and the inverse Fourier transform means 20 is to remove the quantization noise of the spectrum of the decoded speech decoded by the decoding means 15. There is quantization noise all over in the decoded speech shown in FIG. 11(*a*) since the quantization noise is produced in the coding at the speech coding apparatus. Though the part Z of FIG. 11(*b*),(*c*) are-slightly perceived or masked perceptually, there is quantization noise. There is the case of such quantization noise makes the quality of the decoded speech insufficient. Accordingly, it is possible to prevent the quality of the decoded speech from getting bad by removing the quantization noise in the part which is not perceivable. Such quantization noise can be removed by transforming the decoded speech to the frequency spectrum again and suppressing the part which is slightly perceived or masked even after the decoded speech being output.

As mentioned above, it is a feature of this embodiment to implement the transform means, the amplitude suppression means and the inverse transform means. The transform means transforms the synthetic speech into the frequency spectrum at the speech post processor which transforms the frequency spectrum of the speech synthesized by the speech decoding means. When the frequency component concerned is slightly perceived or masked by the effect of the other frequency components around it, the amplitude suppression means suppresses the amplitude of the frequency component concerned of the frequency spectrum output from the transform means. The inverse transform means transforms the frequency spectrum output from the amplitude suppression means into time domain and outputs it outside.

According to this embodiment, there is an effect of reducing the quality deterioration of the decoded speech produced by quantization noise of the frequency spectrum since the frequency components which are slightly perceived or masked perceptually are masked.

Though the speech post processor 17 shown in FIG. 10 is presented in the above embodiment, it is acceptable to process the output speech 5 by using the Fourier transform means 18, the spectrum amplitude suppression means 19 and the inverse Fourier transform means 20. The output speech 5 is output from the speech decoding apparatus 2 shown in FIG. 1. The output speech will result after suppressing the amplitude of the part which can be masked perceptually in the output speech 5. It is also acceptable to produce the output speech after suppressing the amplitude of the part which can be masked perceptually in the output speech being output from the speech synthesis apparatus (not illustrated).

What is claimed is:

1. A speech coding apparatus for coding an input speech signal within an analysis window of an analysis frame, comprising:

(a) window locating means for defining a plurality of analysis windows at different locations in the analysis frame, the window locating means including means for receiving a segment of the input speech signal within each of the analysis windows, means for calculating a predefined feature of the segment of the input speech signal within each analysis window, means for comparing the calculated features of each analysis window, and means for selecting an analysis window based on a result of the comparison;

(b) speech analysis means for extracting characteristic parameters of the input speech signal in the selected analysis window selected by the window locating means; and (c) coding means for receiving the characteristic parameters and for encoding the characteristic parameters.

2. The speech coding apparatus of claim 1, wherein the predefined feature is a power of the input speech signal, and wherein an analysis window having a maximum power value is the window selected.

3. The speech coding apparatus of claim 1 or 2, wherein the speech analysis means comprises:

means for providing a second analysis window different from the selected analysis window: and means for calculating a value of power of the input speech signal within the second analysis window and for outputting the calculated power value to the coding means.

4. The speech coding apparatus of claim 3, wherein a center of the second analysis window is placed at a center of the analysis frame.

5. The speech coding apparatus of claim 3, wherein the analysis frame has a fixed frame length and the second analysis window has a window length which is substantially the same as the analysis frame length.

6. The speech coding apparatus of claim 1, wherein the selected analysis window is the window having a center which is substantially in the center of the analysis frame.

7. The speech coding apparatus of claim 1, wherein the analysis frame has a fixed length and the analysis window has a window length which is substantially the same as the frame length.

8. The speech coding apparatus of claim 1, wherein the predefined feature is a spectrum of the input speech signal of each analysis window and wherein the comparison is a comparison of the spectrums of each analysis window.

9. The speech coding apparatus of claim 1, wherein the predefined feature is an auto correlation of the input speech signal within each analysis window and wherein an analysis window having an auto correlation function having periodicity is the window selected.

10. A speech coding method for encoding input speech within a selected analysis window of an analysis frame, comprising the steps of:

(a) creating an analysis window having a location in the analysis frame;

(b) calculating a value of power of a segment of the input speech signal within the analysis window;

(c) repeating the above steps, such that a plurality of analysis windows are created at a plurality of different locations within the analysis frame;

(d) comparing the power values of each of the plurality of analysis windows and selecting an analysis window of the plurality of analysis windows having a maximum power value.

11. The speech coding method of claim 10, further comprising the steps of:

(a) extracting characteristic parameters of the input speech signal within the selected analysis window;

(b) creating a second analysis window and calculating a value of power of the input speech within the second analysis window; and (c) encoding the extracted characteristic parameters and the calculated power.

12. The speech coding method of claim 11, wherein the step of creating a second analysis window includes a step of positioning a center of the second analysis window at a center of the analysis frame.

13. The speech coding method of claim 12, wherein the step of creating a second analysis window includes a step of setting a length of the second analysis window substantially the same as a length of the analysis frame.

14. A speech coding method for coding an input speech signal comprising the steps of:

receiving a segment of the input speech signal corresponding to an analysis frame of the input speech signal:

creating a plurality of analysis windows at different locations within the analysis frame;

for each one of the plurality of analysis windows, calculating a value of power of the input signal contained within the one of the plurality of analysis windows;

comparing the value of power of each of the plurality of analysis windows;

selecting an analysis window of the plurality of analysis windows having a greatest value of power.

15. The speech coding method of claim 14, further comprising the steps of:

extracting characteristic parameters of the input speech signal within the selected analysis window.

16. The speech coding method of claim 14 further comprising the steps of:

creating a second analysis window within the analysis frame, wherein the second analysis window has a center substantially in the center of the analysis frame; and encoding the extracted characteristic parameters and the calculated power.

* * * * *